United States Patent [19]

Weber

[11] 4,293,288

[45] Oct. 6, 1981

[54] SUBMERSIBLE PUMP HOUSING

[75] Inventor: Walter L. Weber, St. Louis County, Mo.

[73] Assignee: Weber Industries, Inc., St. Louis, Mo.

[21] Appl. No.: 9,245

[22] Filed: Feb. 5, 1979

[51] Int. Cl.[3] ..... F04B 21/00; F04B 39/00

[52] U.S. Cl. ..... 417/434; 415/199.3; 417/424

[58] Field of Search ..... 415/199.3, 199.2, 219 C, 415/501; 418/270; 417/15, 411, 424, 434; 184/6.28; 318/341, 503

[56] References Cited

U.S. PATENT DOCUMENTS

| | | | |
|---|---|---|---|
| 665,999 | 1/1901 | Day | 417/434 |
| 3,288,074 | 11/1966 | Hall | 415/199.3 |
| 3,375,789 | 4/1968 | Easton | 415/199.3 |
| 4,057,365 | 11/1977 | Colmer | 417/44 |

*Primary Examiner*—Harvey C. Hornsby
*Assistant Examiner*—Arthur O. Henderson
*Attorney, Agent, or Firm*—Kalish & Gilster

[57] ABSTRACT

A housing of a single material of construction for a submersible pump adapted to integrally contain the usual diffuser stack and a mounting bracket for the pump motor. The housing is provided upwardly of the lower end thereof with a multiplicity of circumferentially arranged inwardly turned fingers, the upper edges of which constitute shoulders to support the diffuser stack and with the developed apertures constituting outlet ports for water escaping downwardly along the housing wall from the diffuser stack to prevent excessive heating within the housing during operation. The housing also contains an adapter plate at the normally lower end thereof for direct securement to the prime mover.

5 Claims, 4 Drawing Figures

SUBMERSIBLE PUMP HOUSING

BACKGROUND AND SUMMARY OF THE INVENTION

This invention relates in general to submersible pumps of the multi-stage, diffuser type and more particularly to an improved housing therefor.

Heretofore, it has been the accepted and unvaryingly followed practice to build submersible pumps with independent or discrete pump casings and motor mounting brackets. Such casings have been tubes provided with internal threading at each end so as to engage the external threads of a discharge body at one end and those of a motor mounting bracket at the other or lower end. Such brackets have been conventionally produced by costly casting procedures resulting in relatively heavy units and which are constructed of a metal quite distinct from, and dissimilar to, the metal of the associated pump casing. This bi-metallic condition has consistently promoted galvanic corrosion with resultant diminution in the effective life of the pump and with close vigilance throughout pump usage. Furthermore, the provision of these two distinct members necessarily brought about certain time consuming and hence costly procedures in pump assembly.

Additionally, by reason of the utilization of two such distinct pump components, there was the further need to provide an adequate support within the casing for the diffuser stack. As there were not provided any water outlet ports, water which may have seeped between diffuser stack and inner face of the casing side wall would become trapped therein and prone to develop relatively high temperatures which consistently restricted efficient pump action. To the present time, the problems caused by the utilization of an independent pump casing and a motor mounting bracket have not been solved, but have been reluctantly accepted by industry.

Therefore, it is an object of the present invention to provide a housing for a submersible pump which integrally incorporates a mounting bracket for the pump motor, as well as a chamber for receiving the diffuser stack.

It is another object of the present invention to provide a housing of the character stated which is formed of a single material of construction, thereby eliminating the potential for galvanic corrosion.

It is a still further object of the present invention to provide a housing of the character stated which uniquely embodies components developed from the housing wall for supporting the diffuser stack and with the provision of openings serving as outlet ports so that water normally trapped between the diffuser stack and the housing side wall may escape, thereby serving as a coolant as opposed to providing a source of efficiency inhibiting heat.

It is a still further object of the present invention to provide a housing of the character stated which may be most economically manufactured; the use of which conduces to relatively prolonged longevity of the pump in reliable operating state; and which brings about marked savings in pump construction and in pump assembly.

In essence, the present invention comprises a tubular housing having an adaptable plate rigid at its lower end for securement directly to the pump prime mover, thereby embodying a motor mounting bracket and with the upper portion of said housing serving as a chamber for receiving the usual diffuser stack, as of the multi-stage centrifugal pump type. The diffuser stack is supported upon shoulders developed by fingers which have been created through lancing of the housing side wall with such fingers being turned inwardly and hence concurrently creating complementary apertures which serve as outlet ports for water which heretofore would have been retained within the housing between the diffuser stack and the housing side wall, thereby becoming a source of undesired, excessive heat. The housing is easily assembled with the usual pump components, and being of a single material of construction, obviates the possibility for galvanic corrosion as would occur if the diffuser stack-receiving portion and the motor mounting bracket portion were of different metals.

DESCRIPTION OF THE PREFERRED EMBODIMENT

Figure 1:
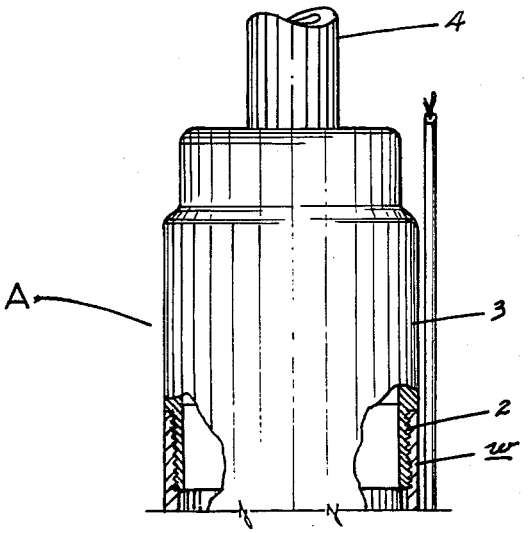
FIG. 1 is a perspective view of a submersible pump incorporating a housing constructed in accordance with and embodying the present invention.
Figure 1:
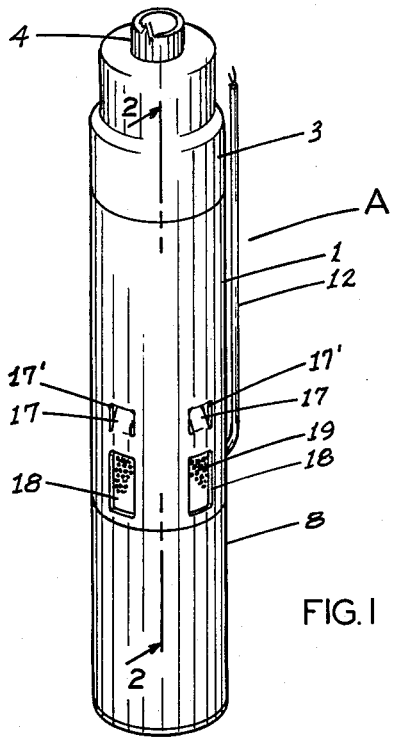
Figure 2:
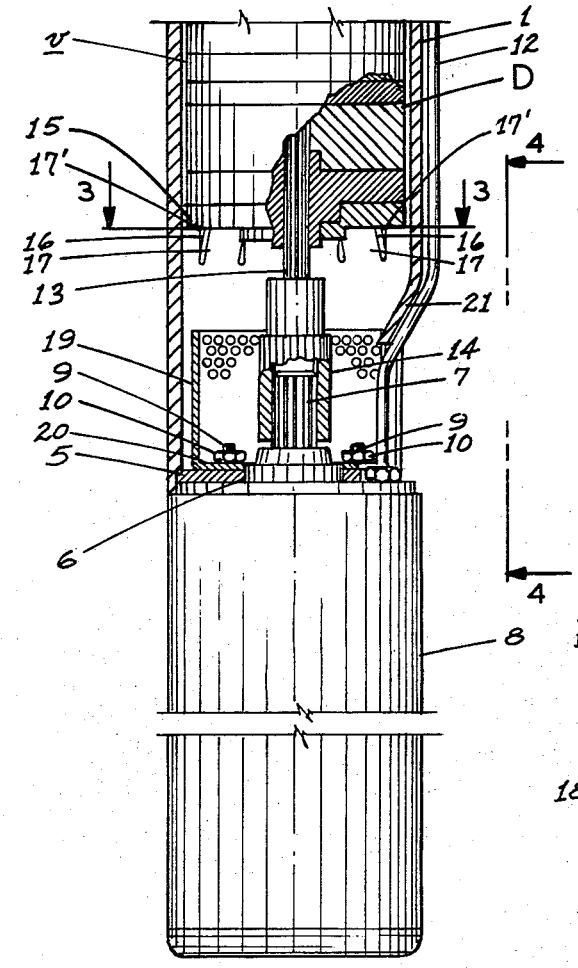
FIG. 2 is a vertical view, partially in section, of the submersible pump.
Figure 3:
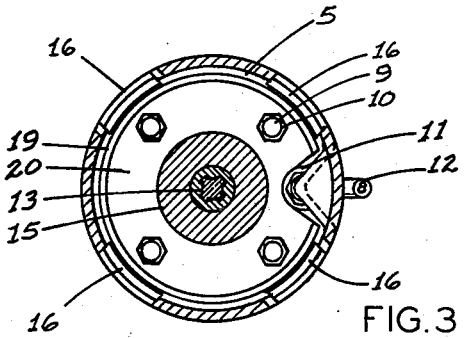
FIG. 3 is a horizontal transverse sectional view taken on the line 3—3 of FIG. 2.
Figure 4:
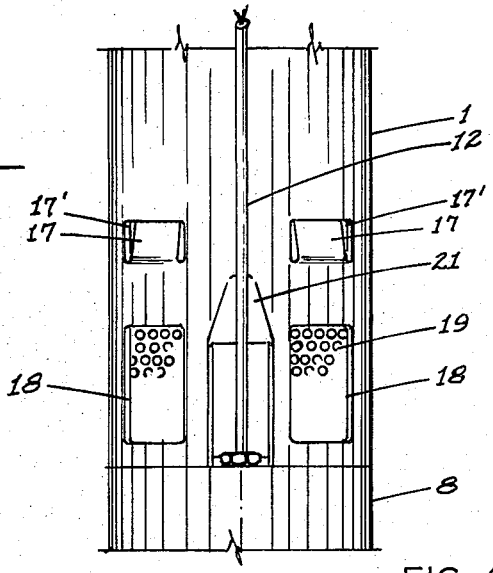
FIG. 4 is a fragmentary elevational view taken on line line 4—4 of FIG. 2.

Referring now by reference characters to the drawings which illustrate the preferred embodiment of the present invention, A generally designates a submersible pump adapted for presentation, as within well casings, for delivery of water from substantial depths, and comprises a tubular housing or shell 1 having a side wall w, being internally threaded at the upper end thereof, as at 2, for engaging, in the usual manner, the external threads provided at the lower end of a valve body 3, which latter is suitably connected in the upper end portion thereof to a discharge conduit 4.

Rigid within housing 1 for disposition across the lower end thereof is an adapter plate 5; being secured to said housing 1 in any suitable fashion, such as by welding. Adapter plate 5 is centrally provided with an opening 6 for projection upwardly therethrough of the drive shaft 7 of the usual motor or prime mover indicated generally at 8. Adapter plate 5 is secured to motor 8 by means of motor studs 9 which extend upwardly through apertures formed in said adapter plate in radially spaced relationship to central opening 6; there being retention nuts 10 tightly engaged upon the projecting portions of studs 9. Adapter plate is also formed with a further opening, as in the character of an edge recess 11 permitting passage therethrough of a cable 12 containing the requisite lead wires.

Drive shaft 7 is operatively engaged to a pump shaft 13 as by means of a standard type coupling 14; said pump shaft 13 progressing upwardly within housing 1, coaxially therewith, for journalling at the upper end thereof within a shaft bearing (not shown) supporting the usual shaft sleeve (not shown).

Pump shaft 13 is externally splined for interengaging the impellers of a conventional diffuser stack designated generally D. Stack D does not form a part of the present invention, but comprehends the usual components; namely, impellers, diffusers and diffuser plates, and being of the type shown and described in U.S. Pat. No. 3,288,074.

Diffuser stack D is disposed upon a bottom plate 15 which serves to direct water into the eye of the immediately adjacent impeller of stack D; said bottom plate 15 being supported upon shoulders 16 defining the upper edges of fingers 17 integral with the wall of housing 1 and turned inwardly thereof by lancing. Said fingers 17 may be of any arcuate extent and in predetermined circumferentially spaced relationship to jointly constitute a reliable support for diffuser stack D. It will be seen that fingers 17 have substantially three edges which, in being removed from conformity with wall w, bring about the development of complementarily formed apertures or fluid outlet ports 17' for purposes presently appearing. In the drawings said fingers 17 are illustrated, for purposes of exposition only, to be four in number and located at substantially 90° intervals. It will be observed that said fingers 117 are integral with housing 1 and are of suitable circumferential extent so as to be stable and resistant to deformation under the imposed load.

Between the lower ends of fingers 17 and adapter plate 5, housing 1 is provided with a plurality of ports 18 which may be relatively elongated vertically and be of any suitable number, and with appropriate spacing, for premitting ingress of water to be pumped. Located immediately inwardly of ports 18, within housing 1, and downwardly of fingers 17 is the usual perforated intake screen 19 having a base portion 20 with suitable openings so as to receive studs 9 and be maintained stably upon adapter plate 5 by said nuts 10. Screen 19 is manifestly of adequate height so as to fully cover ports 18 to prevent the admission of particles of potentially pump-damaging size.

Pump housing 1 in the lower portion of its side wall w is indented as at 21 in registration with adapter plate recess 11 for guiding cable 12 to motor 8.

From the foregoing it will be seen that pump housing 1 is of unitary character, being integrally formed as from a single material of construction, such as stainless steel or the like, and concurrently serves as a suitable casing for diffuser stack D, as well as providing a mounting bracket for motor 8. This integrated construction represents a marked advance in the art, as heretofore submersible pumps have incorporated two discrete components for such purposes; that is, a tubular casing for accepting the diffuser stack and a mounting bracket for the motor, which bracket and casing are interengaged as through co-acting threading or the like. Such motor brackets have conventionally been of cast form and fabricated of a metal distinct from that from which the casing is formed. Normally such brackets have been of considerable weight and, hence, relatively costly. By reason of the present invention there is eliminated the potential of galvanic corrosion as would result from the utilization of dissimilar metals, as is the current practice. It will also be noted that the novel housing 1 incorporates easily formed supports; namely, fingers 17 for diffuser stack D to assure of its appropriate positioning within housing 1. There is, accordingly, obviated the necessity of providing a discrete component for mounted disposition within housing 1 for diffuser stack support.

Another most important advantage achieved by the unitary housing 1 is that with fingers 17 being bent inwardly from wall w, the developed apertures 17' serve as outlet ports for water that may enter into the annular spacing, as exaggeratedly indicated at v, between diffuser stack D and the inner face of housing wall w, so that the components of stack D may be cooled. Heretofore, with the independent casing and mounting bracket construction, such water has been trapped and thereby has developed substantial temperatures by reason of heat transfer, with the resulting excessive heating of the fluid in pump A and with a potential for providing a restraint against efficient pump action. Accordingly, the novel finger-aperture arrangement brings about results hitherto unobtained in submersible pumps, with resultant increased life and efficiency of such pumps.

From the foregoing, as well as a perusal of the drawings, it is quite evident that the assembly of pump A is relatively easily and economically achieved since there is obviated the heretofore accepted necessity of assembling and interengaging independent casings and motor mounting brackets.

Having described my invention, what I claim and desire to obtain by Letters Patent is:

1. For use with a submersible pump having a pump assembly, means defining a tubular housing integrally fabricated of a single material of construction, there being a motor mounting bracket plate fixedly provided at the normally lower end of said housing, and pump assembly support means provided internally of said housing upwardly of said bracket plate formed unitarily with said housing for supporting said pump assembly and comprising a plurality of discrete finger-like projections constituted by portions of said housing turned inwardly from conformity with the wall thereof, each providing an upper edge constituting a shoulder for supported disposition thereon of the pump assembly, each of said finger-like projections being bent inwardly along a lower circumferential line and with the resultant opening constituting a liquid outlet port for liquid escaping downwardly along the housing between same and the pump assembly.

2. The invention as defined in claim 1 and further characterized by said finger-like projections being circumferentially arranged about said housing and in preselected spaced relationship.

3. The invention as defined in claim 1 and further characterized by aperture-forming means provided in said mounting bracket plate for accepting means for engagement to a pump motor.

4. The invention as defined in claim 3 and further characterized by registering outwardly opening recess-forming means provided in the housing and the mounting bracket plate for receiving a cable.

5. A submersible pump comprising means defining a unitary housing fabricated of a single metal and being of annular cross-section, a pump discharge body engaged to said housing in the upper end of the latter, said housing having a mounting bracket plate fixed at its lower end, said plate having a central opening and a plurality of radially spaced openings, a prime mover having a drive shaft, means extending through said mounting bracket plate radial openings for engaging said prime mover to said plate with said drive shaft projecting through said plate central opening, a pump shaft coupled to said drive shaft within said pump housing and progressing coaxially therethrough, a plurality of circumferentially spaced inlet openings provided in said housing immediately proximate said adapter plate for serving as liquid inlet ports, said housing further having a plurality of circumferentially spaced, inwardly bent finger members, upwardly of said inlet ports, said finger member coordinating to define a support edge, a pump assembly engaged upon said pump shaft and supported upon said support edge, said inwardly bent finger members defining openings in said housing complementary with said inwardly bent members for providing liquid outlet ports, the latter being in upwardly spaced relationship to said liquid inlet ports, a cable, and registering, outwardly opening, recess-forming means provided in said housing and said bracket plate for passage therethrough of said cable for connection to said prime mover.

* * * * *